US009643818B2

(12) United States Patent
Sen

(10) Patent No.: US 9,643,818 B2
(45) Date of Patent: May 9, 2017

(54) DOUBLE-DECKER ELEVATOR WITH ADJUSTABLE INTER-CAR SPACING

(71) Applicant: Inventio AG, Hergiswil (CH)

(72) Inventor: Fuat Sen, Sursee (CH)

(73) Assignee: SCHINDLER AUFZÜGE AG, Hergiswil (CH)

( * ) Notice: Subject to any disclaimer, the term of this patent is extended or adjusted under 35 U.S.C. 154(b) by 79 days.

(21) Appl. No.: 14/650,943

(22) PCT Filed: Nov. 29, 2013

(86) PCT No.: PCT/EP2013/075074

§ 371 (c)(1),
(2) Date: Jun. 10, 2015

(87) PCT Pub. No.: WO2014/090600

PCT Pub. Date: Jun. 19, 2014

(65) Prior Publication Data

US 2015/0314990 A1 Nov. 5, 2015

(30) Foreign Application Priority Data

Dec. 10, 2012 (EP) ..... 12196306

(51) Int. Cl.
*B66B 11/02* (2006.01)
*B66B 1/42* (2006.01)
*B66B 7/06* (2006.01)

(52) U.S. Cl.
CPC ..... *B66B 11/022* (2013.01); *B66B 1/425* (2013.01); *B66B 7/062* (2013.01)

(58) Field of Classification Search
CPC ..... B66B 1/42; B66B 1/425; B66B 11/022
See application file for complete search history.

(56) References Cited

U.S. PATENT DOCUMENTS

| | | | | |
|---|---|---|---|---|
| 1,914,128 | A * | 6/1933 | James | B66B 1/425 187/249 |
| 7,232,011 | B2 * | 6/2007 | Strebel | B66B 1/42 187/249 |
| 7,581,621 | B2 * | 9/2009 | Kontturi | B66B 1/425 187/291 |
| 8,800,721 | B2 * | 8/2014 | Cortona | B66B 11/022 187/257 |
| 2006/0163006 | A1 | 7/2006 | Strebel et al. | |
| 2006/0191747 | A1 * | 8/2006 | Mustalahti | B66B 1/42 187/249 |

(Continued)

FOREIGN PATENT DOCUMENTS

| | | | |
|---|---|---|---|
| JP | 2007331871 | A1 | 12/2007 |
| WO | 2011073030 | A1 | 6/2011 |

*Primary Examiner* — Minh Truong
(74) *Attorney, Agent, or Firm* — Fraser Clemens Martin & Miller LLC; William J. Clemens

(57) ABSTRACT

An elevator installation has an elevator car carrier that can be displaced in a travel space, a first elevator car arranged on the carrier in an adjustable manner, and a second elevator car arranged on the carrier. A drive unit on the carrier drives a traction device to adjust the first elevator car relative to the carrier. The traction device forms a closed loop and is guided over a drive roller and at least one guide roller, which rollers are arranged on the carrier. The guide roller is displaceable on the carrier to set tensioning of the traction device.

12 Claims, 2 Drawing Sheets

(56) References Cited

U.S. PATENT DOCUMENTS

| | | | | |
|---|---|---|---|---|
| 2015/0122591 | A1* | 5/2015 | Kato | B66B 5/12 187/401 |
| 2016/0096707 | A1* | 4/2016 | Banno | B66B 11/022 187/247 |
| 2016/0311655 | A1* | 10/2016 | Cortona | B66B 9/00 |

* cited by examiner

Section A-A

Section B-B

DOUBLE-DECKER ELEVATOR WITH ADJUSTABLE INTER-CAR SPACING

FIELD

The invention relates to an elevator installation with at least one elevator car carrier, which can receive two or more elevator cars. The invention specifically relates to the field of elevator installations designed as so-called double-decker elevator installations.

BACKGROUND

A double-decker elevator is known from JP 2007-331871 A. The known elevator comprises an elevator car frame in which two elevator cars are arranged vertically one above the other. The two elevator cars each stand on a carrier with guide rollers, wherein lifting cables are led around the guide rollers. In addition, provided at the elevator car frame is a drive unit around which the lifting cable is guided. Through actuation of the lifting cable by means of the drive unit the thus-suspended elevator cars can be raised and lowered relative to the elevator car frame. The two elevator cars can thereby be differently positioned within the elevator car frame.

A further double-decker elevator is described in WO 2011/073030 A1. The mechanism provided for suspension and adjustment of the elevator cars is here distinguished, by comparison with the afore-mentioned double-decker elevator, by the use of belts. Since belts are in one dimension of slender construction by comparison with a lifting cable significantly smaller bending radii around the guide rollers can be achieved. Accordingly, the diameter of a guide roller can be dimensioned to be smaller. This leads overall to a mechanism which demands less installation space at the car frame and which allows more design freedom for dimensioning of the elevator cars.

However, according to WO 2011/073030 A1 the belt guide at the elevator car frame for realization of the suspension of the elevator cars is relatively complicated. The numerous deflections of the belt at the elevator car frame lead to, in particular, a mechanism comprising numerous guide rollers. In addition, the elevator cars have to be equipped with under tensioning means in order to prevent jumping of the elevator car in the elevator car frame in the event of strong decelerations such as, for example, in the case of travel onto a buffer or safety braking.

SUMMARY

It is the object of the invention to create an elevator installation having an improved construction. Specifically, it is an object of the invention to create an elevator installation in which the space left for the elevator cars is optimized and in which the mechanism for adjusting the distance between the elevator cars is of particularly simple construction.

The object is fulfilled by an elevator installation comprising a first elevator car which is adjustably arranged at the elevator car carrier and at least one second elevator car which is arranged at the elevator car carrier. In addition, a drive unit, which is arranged at the elevator car carrier, and at least one traction means are provided. In that case at least the first elevator car is adjustable by the drive unit by way of the traction means relative to the elevator car carrier. The traction means preferably forms a closed loop.

The closed loop can be realized by way of a traction means formed as an endless loop. Alternatively thereto the closed loop of the traction means can also be achieved by the ends of the traction means being fixed in a connecting element.

Thanks to the closed loop the first elevator car can be both suspended at the elevator car carrier, and also tensioned, by way of the traction means. The first elevator car is therefore not only adjustable by the traction means, but also fixedly connected with the elevator car carrier in the case of emergency or safety braking and prevented from jumping. The additional mounting of under tensioning means can thus be eliminated.

It is advantageous that the traction means is guided by way of a drive roller and at least one guide roller, which are both arranged at the elevator carrier. In that case the traction means is guided by the drive roller and the at least one guide roller in particularly simple manner at the elevator car carrier.

Advantageously, a guide roller is arranged at the elevator car carrier to be displaceable in position. Tensioning of the traction means is thus settable by way of positional displacement of the guide roller. Undesired natural vibrations of the traction means can thereby be minimized so that travel comfort can be further increased and faultless guidance of the traction means ensured.

In the embodiment of the elevator installation the elevator car carrier can in advantageous manner be arranged in an elevator shaft, wherein a drive motor unit serving for actuation of the elevator car carrier is provided. The elevator car carrier can thereby be moved along the provided travel path. In that case, the elevator car carrier can be suspended at a traction means connected with the elevator car carrier. The traction means can in that regard be guided in suitable manner over a drive pulley of a drive motor unit. In that case the traction means can also have the function, apart from the function of transmitting the force or the moment of the drive motor unit to the elevator car carrier in order to actuate the elevator car carrier, of supporting the elevator car carrier. By "actuation of elevator car carrier" there is to be understood in this instance, in particular, raising or lowering of the elevator car carrier in the elevator shaft. The elevator car carrier can then be guided in the elevator shaft by one or more guide rails.

It is advantageous if the second elevator car is adjustably arranged at the elevator car carrier, if the second elevator car is adjustable relative to the elevator car carrier by the drive unit by way of the traction means and if in the case of adjustment of the first elevator car and the second elevator car relative to the elevator car carrier the first elevator car and the second elevator car are adjustable in adjustment directions opposite to one another. Thus, a simultaneous adjustment of the two elevator cars relative to one another can be effected by driving the traction means. Since the adjustment directions of the two elevator cars are opposite to one another the speed of the adjustment movements of the two elevator cars is summated with respect to change in the mutual spacing of the two elevator cars. In addition, compensation for the gravitational force of the first elevator car and the second elevator car is provided at least in part. In that regard, a drive unit of smaller size can be used.

Advantageously, the first elevator car and the second elevator car are connected with the traction means by way of a first or a second holding element. The holding element can preferably be such that a suspension force of the first or second elevator car at the traction means is introduced in vertical alignment with the traction means at the first or second holding element. Loading of the traction means is thereby optimal. The service life of the traction means is correspondingly increased.

It is advantageous if the traction means is formed as a belt. In particular, it is advantageous if the belt has a first side and a second side remote from the first side and if the first side serves as a contact side at which the belt is guided around the drive roller of the drive unit and around the guide roller and at which the belt is bent and if the second side serves as a free rear side at which the belt, at least substantially, is not bent. Reverse bendings in the belt can thereby be at least largely avoided.

Advantageously, the belt conveyed is formed as a flat belt. In this form, the belt is of particularly simple design and accordingly economic to produce.

It is advantageous if the belt at the contact side has at least one longitudinal rib. In that event, the longitudinal rib can have, in particular, a V-shaped profile. For preference, a plurality of longitudinal ribs, which are each formed to be at least approximately V-shaped, is formed at the contact side. Other designs of the profile of the longitudinal rib are also possible. For example, the longitudinal rib can have a trapezium-shaped profile. A high level of traction is transmissible from the drive roller to the belt by means of these longitudinal ribs. In addition, the longitudinal ribs reliably guide the belt at the drive and guide rollers.

Alternatively thereto the belt can have a toothing at the contact surface. The drive power of the drive unit is transmissible particularly reliably from the drive roller to the belt by means of the toothing. Slip between the drive roller and the belt is largely prevented by the mechanically positive force transmission.

Finally, the traction means can also be formed as a cable.

DESCRIPTION OF THE DRAWINGS

The invention is explained in more detail by way of embodiments in the following description and by way of the accompanying drawings, in which corresponding elements are provided with corresponding reference numerals and in which.

DETAILED DESCRIPTION

Figure 1:
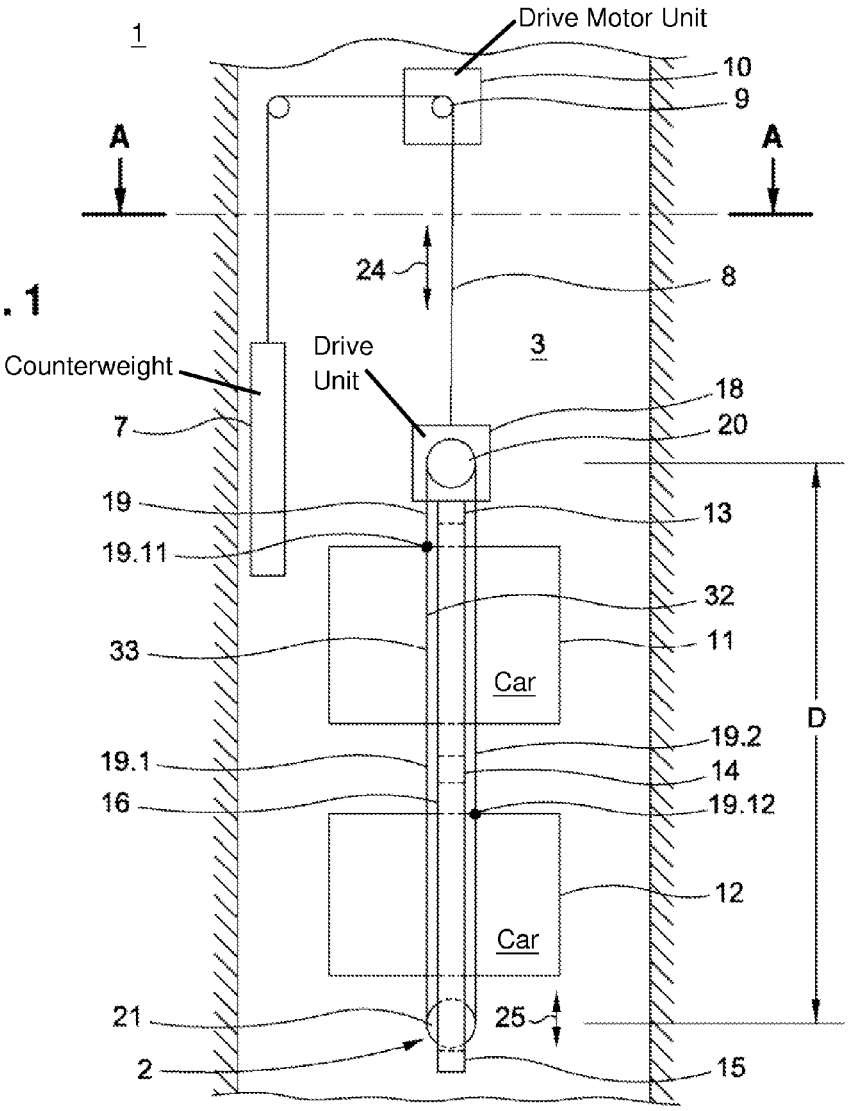
FIG. 1 shows an elevator installation in a schematic illustration in correspondence with a first embodiment of the invention.

FIG. 1 shows an elevator installation 1 with at least one elevator car carrier 2, which is movable in a travel space 3 provided for travel of the elevator car carrier 2. The travel space 3 can, for example, be provided in an elevator shaft of a building.

In the illustrated example the elevator car carrier 2 is suspended at a first end of the suspension device or means 8. The suspension means 8 is, in addition, led around a drive pulley 9 of a drive motor unit 10. The elevator car carrier 2 is moved upwardly or downwardly through the travel space in correspondence with an instantaneous direction of rotation of the drive pulley 9. Finally, a counterweight 7 is suspended at a second end of the suspension means 8. The expert can obviously provide a suspension of the elevator car carrier 2 or the counterweight 7 differing therefrom. Thus, for example, the elevator car carrier 2 or the counterweight 7 can each be suspended at a respective support roller.

A first elevator car 11 and a second elevator car 12 are arranged at the elevator car carrier 2. In that case, the two elevator cars 11, 12 are adjustable relative to the elevator car carrier 2.

Cross members 13, 14, 15, which are connected with longitudinal girders 16, 17 of the elevator car carrier 2, are formed at the elevator car carrier 2. A longitudinal direction 24 of the elevator car carrier 2 is defined in correspondence with a travel direction 24. The longitudinal girders 16, 17 of the elevator car carrier 2 are in that case oriented along the longitudinal direction 24. The cross members 13 to 15 are arranged between the longitudinal girders 16, 17 perpendicularly to the longitudinal direction 24.

The elevator car carrier 2 is suspended at the first end of the suspension means 8 by way of the cross member 13. In addition, a drive unit 18 is mounted on the cross member 13. The drive unit 18 serves for driving a belt 19. For that purpose, the belt 19 is guided around a drive roller 20 of the drive unit 18. In addition, the belt 19 is guided by way of a guide roller 21. This guide roller 21 is mounted on the cross member 15. The belt 19 forms a closed loop and extends substantially from the drive roller 20 once vertically downwardly to the guide roller 21 and from the guide roller 21 a further time vertically upwardly to the drive roller 20 over the entire length of the elevator car carrier 2. In that regard, a respective axis of rotation of each of the drive and guide rollers 20, 21 is oriented parallelly to the cross members. The drive and guide rollers 20, 21 are so arranged at the cross member 13 and cross member 15, respectively, that the belt 19 is guided laterally at the elevator cars 11, 12.

The belt 19 can thus be guided only at the first side 32 serving as front side 32, in which case the second side 33 serves as a free rear side 33. Depending on the respective design of the belt 19, loading of the belt 19 can thereby be reduced.

The guide roller 21 is arranged at the elevator car frame 2 or cross member 15 to be displaceable in position. As indicated in FIG. 1, the spacing D between the guide roller 21 and the drive roller 20 is settable in a vertical adjustment direction 25. The tension of the belt 19 can be set to a specific amount by way of setting this spacing D so as to substantially avoid undesired natural oscillations. Setting of the tension is largely oriented to the cross-section used, the length and the intrinsic weight of the belt 19 as well as the rotational speed of the drive roller 20 and the power transmitted to the belt 19.

The first elevator car 11 is suspended at a first run 19.1 of the belt 19 by means of a first holding element 19.11 at the belt 19 and the second elevator car 12 is suspended at a second run 19.2 of the belt 19 by means of a second holding element 19.12 at the belt 19. In that case, the two runs 19.1, 19.2 lie on different sides with respect to the drive roller 20. Correspondingly, the two elevator cars 11, 12 are moved in different adjustment directions in the case of rotational movement of the drive roller 20. In addition, at least partial compensation is provided for the gravitational forces of the two elevator cars 11, 12. Consequently, in this design the drive unit 18 can be dimensioned to be smaller.

Figure 2:
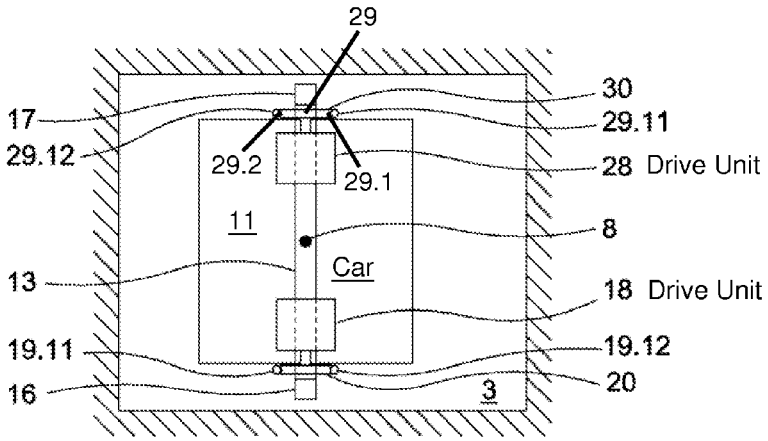
FIG. 2 shows the elevator installation, which is illustrated in FIG. 1, in a plan view.

FIG. 2 shows the elevator installation of FIG. 1 as a plan view. The elevator installation preferably comprises a further drive unit 28 with a further belt 29, which is driven by a further drive roller 30 and which is guided by a further guide roller (not shown here). The further drive unit 28 as well as the associated further drive roller 30 are arranged on the cross member 13 to be opposite the drive unit 18. The further guide roller is arranged at the cross member 15 to be correspondingly opposite the guide roller 21. Analogously to the belt 19, the further belt 29 is guided between the further drive roller 30 and the further guide roller and forms a closed loop. Here, too, the further guide roller is mounted on the elevator car frame 2 or the cross member 15 to be displaceable in position for setting the tension of the belt 29. Analogously to the belt 19, the further belt 29 is laterally guided on opposite sides of the first and second elevator cars.

The first elevator car 11 is suspended at a first run 29.1 of the further belt 29 by means of a further first holding element 29.11 at the further belt 29 and the second elevator car 12 is suspended at a second run 29.2 of the further belt 29 by means of a further, second holding element 29.12 at the further belt 29. In that case, the two runs 29.1, 29.2 lie on different sides with respect to the further drive roller 30. The further first holding element 29.11 lies diagonally opposite the first holding element 19.11 and the further, second holding element 29.12 lies diagonally opposite the second holding element 19.12 so that the first elevator car 11 and the second elevator car 12 are suspended symmetrically with respect to the centers of gravity thereof. Correspondingly, in the case an adjusting movement of the elevator cars 11, 12 the further drive roller 30 rotates in an opposite direction with respect to the first drive roller 20. It is thus ensured that in the case of an adjusting movement of the elevator cars 11, 12 the two belts 19, 29 work in the same adjustment direction.

Moreover, the elevator installation comprises a synchronizing unit (not shown) which ensures synchronous operation of the two drive units 18, 28. For that purpose the synchronizing unit is at least equipped with a microprocessor which activates the two drive units 18, 28.

Alternatively, the drive roller 20 and the further drive roller 30 can be driven by a common drive unit. In such an embodiment the drive unit comprises a transmission in order to generate rotational movement of the drive roller 20 and the further drive roller 30 in opposite sense, as well as one or more drive shafts so as to overcome the distance between the two drive rollers 20, 30.

An embodiment is obviously also possible in which the respective holding elements 19.11, 29.11 and 19.12, 29.12 lie on the same side with respect to the cross members 13, 14, 15. In that case, for example, in the last-mentioned embodiment with only one drive unit it is possible to dispense with a transmission for achieving the rotational movements of the drive roller 20 and the further drive rollers 30 in opposite sense.

In a further possible embodiment the drive units 18, 28 as well as the associated drive rollers 20, 30 can be arranged on the cross member 15 and the guide rollers 21 on the cross member 13.

In yet a further possible embodiment, in departure from two belts 19, 29 also only one belt or more than two belts for producing adjusting movement of the first and second elevator cars 11, 12 is or are usable. The associated drive rollers, guide rollers or drive units are to be appropriately adapted. In addition, a respective belt can also be guided by more than only one guide roller so as to adapt the belt guidance to the given spatial conditions.

Figure 3:
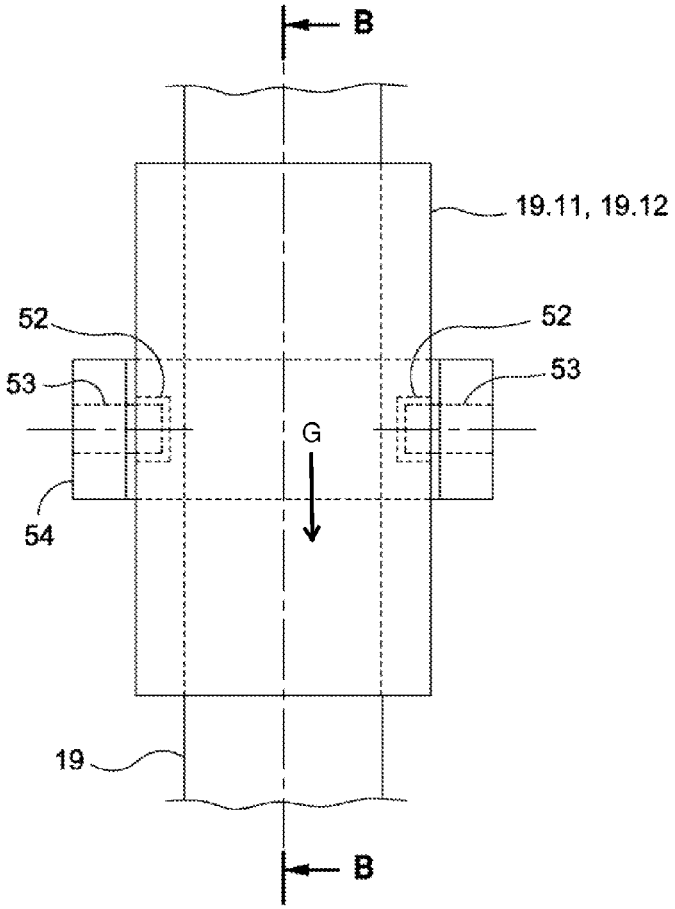
FIG. 3 shows the profile of a belt for an elevator installation in a schematic illustration in correspondence with a first embodiment as well as a holding element for suspension of an elevator car.
Figure 4:
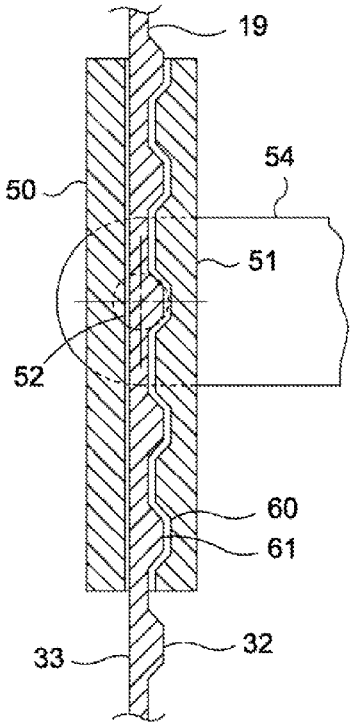
FIG. 4 shows the belt illustrated in FIG. 2 or the holding element in a plan view.

FIG. 3 and FIG. 4 show a holding element 19.11, 19.12 for suspension of an elevator car 11, 12 at the belt 19. The holding element 19.11, 19.12 comprises two housing halves 50, 51, which can be screw-connected together by means of, for example, at least one screw connection. According to FIG. 3 the belt 19 can be formed as a cogged belt. In this embodiment, recesses 60 for reception of the toothing 61 of the cogged belt are provided at the holding element 19.11, 19.12 or at one housing half 50. When the housing halves 50, 51 are screw-connected together a mechanically positive connection between the holding element 19.11, 19.12 and the belt 19 can thus be realized. In that case, the belt 19 is clamped between the two housing halves 50, 51.

Moreover, the holding element 19.11, 19.12 has two bores 52 arranged at the side surfaces of the holding element 19.11, 19.12. The bores 52 are so dimensioned that a respective bolt 53 is introducible thereinto. The bolts 53 are part of a lever arm 54 which is fastened to an associated elevator car 11, 12. The two bores 52 preferably lie in a plane of symmetry of the belt 19. It is thus ensured that a suspension force G of each elevator car 11, 12 at its holding element 19.11, 19.12 is introduced into the belt 19 in vertical alignment.

In a particularly preferred embodiment of the elevator installation a holding element 19.11, 19.12 combines the function of suspension of an elevator car 11, 12 and the function of connecting the two ends of the belt 19 to form a closed loop. The holding element 19.11, 19.12 is thus also here a connecting element. Obviously, a separate connecting element can be provided in addition to the holding elements 19.11, 19.12. Such a connecting element can, analogously to the illustrated holding element 19.11, 19.12, similarly consist of two sub-members which can be screw-connected together and by which a mechanically positive connection between the two ends of the belt 19 and the connecting element can be produced.

Alternatively thereto, it is also possible to use a belt 19 formed as an endless belt or belt with an endless loop. In the case of such a design a connecting element is redundant.

Figure 5:
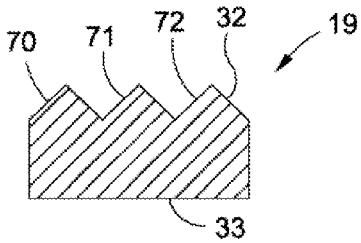
FIG. 5 shows the profile of a belt for an elevator installation in a schematic illustration in correspondence with a second embodiment.

FIG. 5 shows a profile of the belt 19 in correspondence with a second embodiment in a schematic illustration. The belt 19 can be formed as a wedge ribbed belt and have a plurality of ribs 70, 71, 72. In that case, each of the ribs 70 to 72 can have an approximately V-shaped cross-section. In this embodiment the formation with ribs 70 to 72 is provided at the first side 32. The second side 33 is formed to be flat. The belt 19 is thus profiled at one side, namely at the first side 32. The first side 32 in that case serves as contact side.

Moreover, it is also possible to use a belt 19 formed as a flat belt 19. The first side 32 is also formed to be flat in such a belt 19. In that regard, the first side 32 can be formed in correspondence with the second side 33, as is illustrated in FIG. 3. However, a specific surface structure can then be provided so as to improve friction in the case of co-operation with the drive wheel 20 of the drive unit 18.

In the case of a belt 19 formed to be flat at least one of its sides 32, 33 the flat side 32, 33 is preferably guided over a cambered roller or the like. The guide surface of the cambered roller is in that case formed to be convexly curved. Moreover, the convex guide surface is preferably bounded by lateral shoulders for guidance of the belt 19.

As an alternative, a cable can also be used instead of a belt 19.

The invention is not restricted to the described embodiment.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation having an elevator car carrier movable in a travel space, a first elevator car adjustably arranged at the elevator car carrier and a second elevator car arranged at the elevator car carrier comprising:

a drive unit arranged at the elevator car carrier;

a drive roller rotated by the drive unit;

a guide roller arranged at the elevator car carrier and being displaceable relative to the elevator carrier unit; and a traction device guided by the drive roller and the guide roller and suspending the first elevator car and the second elevator car, wherein at least the first elevator car is adjustable relative to the elevator car carrier by the drive unit driving the traction device through the drive roller, the traction device forming a closed loop, and wherein a tension of the traction device is settable by displacement of the guide roller relative to the elevator car carrier; wherein the traction device travels directly between the drive roller and the guide roller, the first elevator car is suspended on a first portion of the traction device and the second elevator car is suspended on a second portion of the traction device, and wherein the first portion and the second portion travel in opposite direction from each other.

2. The elevator installation according to claim 1 wherein the second elevator car is adjustably arranged at the elevator car carrier and is adjustable relative to the elevator car carrier by the drive unit driving the traction device through the drive roller, and wherein the first elevator car and the second elevator car are adjustable oppositely to one another when the first elevator car and the second elevator car are adjusted relative to the elevator car carrier.

3. The elevator installation according to claim 1 wherein the traction device is formed as an endless loop.

4. The elevator installation according to claim 1 wherein opposite ends of the traction device are fixed together in a holding element.

5. The elevator installation according to claim 1 wherein the first elevator car is connected with the traction device by a first holding element.

6. The elevator installation according to claim 5 wherein a suspension force of the first elevator car at the traction device is introduced in vertical alignment with the traction device at the first holding element.

7. The elevator installation according to claim 5 wherein the second elevator car is connected with the traction device by a second holding element.

8. The elevator installation according to claim 7 wherein a suspension force of the second elevator car at the traction device is introduced in vertical alignment with the traction device at the second holding element.

9. The elevator installation according to claim 1 wherein the traction device is formed as a belt having a first side and a second side remote from the first side, and wherein the first side is a front side that contacts the drive roller of the drive unit and the guide roller and the second side is a free rear side.

10. The elevator installation according to claim 9 wherein the belt has a toothing formed at the front side.

11. The elevator installation according to claim 9 wherein the belt has at least one longitudinal rib with a V-shaped profile formed at the front side.

12. The elevator installation according to claim 9 wherein the belt is formed as a flat belt.

* * * * *